US006866001B1

(12) United States Patent
Cuccia

(10) Patent No.: US 6,866,001 B1
(45) Date of Patent: Mar. 15, 2005

(54) BOAT FOLD-AWAY TRANSPORT PLATFORM

(76) Inventor: John G. Cuccia, 1212 N. Montgomery St., Ojai, CA (US) 93023

( * ) Notice: Subject to any disclaimer, the term of this patent is extended or adjusted under 35 U.S.C. 154(b) by 0 days.

(21) Appl. No.: 10/777,761

(22) Filed: Feb. 13, 2004

(51) Int. Cl.[7] ..... B63B 8/00
(52) U.S. Cl. ..... 114/343; 114/364
(58) Field of Search ..... 114/343, 364, 114/258, 259

(56) References Cited

U.S. PATENT DOCUMENTS 3,805,722 A * 4/1974 Melchert et al. ..... 114/343
5,636,587 A * 6/1997 Klimowicz ..... 114/259
2004/0089218 A1 * 5/2004 Cannon, Jr. ..... 114/343

* cited by examiner

*Primary Examiner*—Ed Swinehart
(74) *Attorney, Agent, or Firm*—Albert O. Cota

(57) ABSTRACT

A fold-away transport platform that is attached to a stern portion of a boat and that is used for carrying sizeable items. The platform (24) consists of a pair of side supports (28), each having a first end and a second end. A plurality of cross members (38) are disposed between the side supports which form the platform, that when extended, is cantilevered outward away from the stern of the boat. Pivoting hinge brackets (42) are attached onto the side support first end and the boat stern inside a transom **(26*b*). At least two diagonal braces (52) are removably fastened to the boat on a lower end and to a cross member such that the braces (52)** may be detached and the platform pivoted into the boat for transportation and storage. A second embodiment attaches the platform to the boat stern rail instead of the inner surface of the transom.

17 Claims, 6 Drawing Sheets

BOAT FOLD-AWAY TRANSPORT PLATFORM

TECHNICAL FIELD

The invention generally pertains to platforms, and more specifically to an outward-extending platform on a boat that folds into the boat when not in use, and that is utilized for transporting items, such as canoes, sail boards, inflatable boats and the like.

BACKGROUND ART

Previously, many types of collapsible platforms have been used to provide an effective means for storing goods and large items by extending the length or size of a storage area. In most cases, the platforms consist of detachable truck bed extension, especially for pickup trucks.

A search of prior art did not disclose any patents that possess the novelty of the instant invention and no boat platforms, other than hull extensions, were found. However, the following U.S. patents are considered related:

| U.S. Pat. No. | Inventor | Issue Date |
|---|---|---|
| 4,020,957 | Wren | May 3, 1977 |
| 4,474,131 | Buirski | Oct. 2, 1984 |
| 4,519,336 | Mason | May 28, 1985 |
| 5,755,480 | Bryan | May 26, 1998 |
| 6,422,627 | Kuhn et al. | Jul. 23, 2002 |
| 6,648,391 | Whiteford et al. | Nov. 18, 2003 |

Wren in U.S. Pat. No. 4,020,957 teaches a detachable truck bed extension and loading ramp that is attached to the rear edge of a truck bed. Two triangular upper sections fold over lower triangular sections to provide a ramp for equipment transported in the truck.

U.S. Pat. No. 4,474,131 issued to Buirski is for a convertible boat/canopy adapted to be used as a partial boat hull or a vehicle canopy. Two longitudinal walls define opposite ends of the invention, with end walls defining a gunwale. At least one extension secures one of the end walls and includes mechanical interconnectors for releasably securing the wall forming the partial boat hull.

Mason in U.S. Pat. No. 4,519,336 discloses an attachment that creates a rearward extension of a boat hull. The attachment is secured to a transom of the boat to form an extension of an underside portion of the hull. A forward portion of the hull extension is pivotally connected to the transom, thus allowing pivotation for cruising and rough weather conditions. A hydraulic piston and cylinder device provides the pivotation of the hollow body.

Bryan in U.S. Pat. No. 5,755,480 teaches a truck bed extension for pickup truck having a pair of cleats and brackets to facilitate loading and unloading the extension, which is mounted on the rear end of the pickup truck bed. The extension includes a frame with side members, and tailgate brackets that engage a latching pin on the truck. An extended tailgate is included that completely closes the rear portion of the extension.

U.S. Pat. No. 6,422,627 issued to Kuhn, et al is for an extension apparatus for enclosing a vehicle storage area. The apparatus utilizes using a bracket and frame construction to provide a foldable, lightweight extension device.

Whiteford, et al in U.S. Pat. No. 6,648,391 discloses a truck bed extension device for use with a truck that allows items to be carried beyond the overhang of the truck bed. The device consists of a deck support structure and a signaling system. In a second embodiment a truck hitch structure is used for coupling the truck to a trailer.

For background purposes and as indicative of the art to which the invention is related reference may be made to the remaining cited patent issued to Bauer in U.S. Pat. No. 6,435,588.

DISCLOSURE OF THE INVENTION

Pleasure craft normally include very little spare area for storage of large items such as canoes, sail boards, inflatable boats etc. which are often the same length as the width of typical motor-powered boat. Therefore the primary object of the invention is to provide a simple overhanging transport platform for carrying and stowing large bulky items while a boat is in use.

It is desirable in many instances to have one or more smaller watercraft along for other sporting purposes while using a larger boat for transportation. An important object of the invention therefore allows this type of watercraft to be carried and stored out of the way, without affecting the boat's original functional operation or using space meant for other purposes.

Another object of the invention is that when the boat is moored with no smaller watercraft stored on the platform, the entire structure may be rotated into a storage position within the boat itself. This situation is easily accomplished by merely removing a clevis pin from each hinge bracket attached to the boat transom and manually lifting the platform, which arcs into the boat until the platforms rests on the deck.

Still another object of the invention is realized during storage, when the platform is collapsed, as it is isolated within the boat and does not prevent normal covering of the boat for weather protection.

The platform is fabricated of welded metal tubing which is lightweight, strong and relatively inexpensive.

A further object of the invention provides an extended deck area for uses other than transportation of items, such as resting, sun bathing, fishing, etc. This object is achieved with the use of an optional catamaran tarp, netting or canvas that is stretched between the outer structural members of the platform and which permits a person to walk and sit on the platform.

A final object of the invention requires only minor modification to the boat as only the pivoting hinge brackets need to be attached to the stern of the boat on the transom or railing in a conventional manner.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
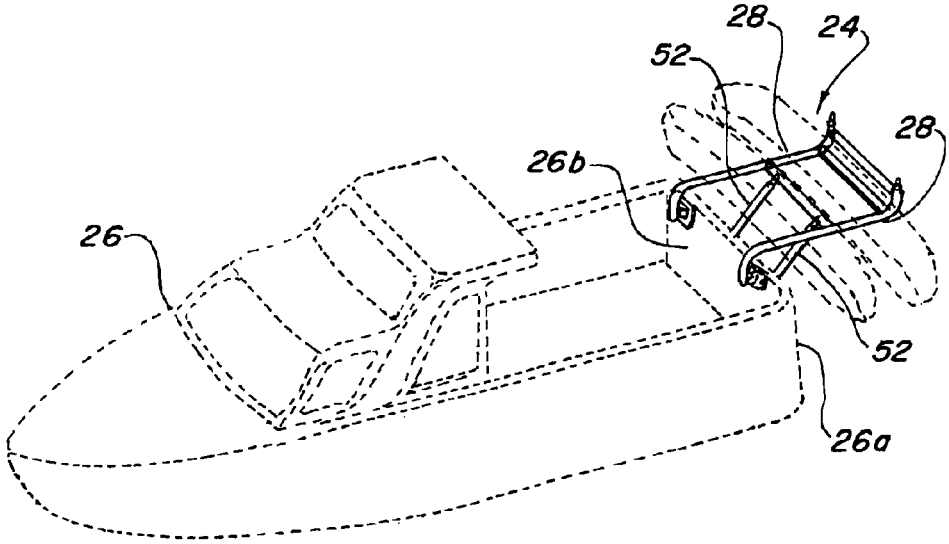
FIG. 1 is a partial isometric view of the preferred embodiment installed on a boat, with the boat illustrated in dotted lines.
Figure 2:
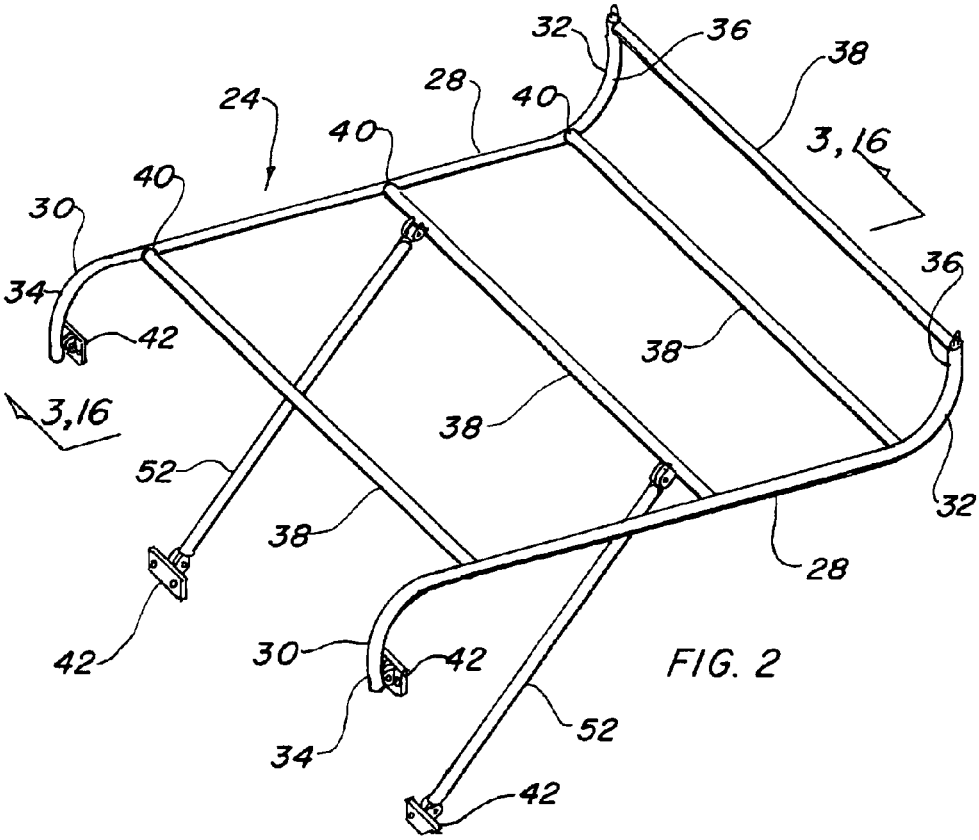
FIG. 2 is a partial isometric view of the preferred embodiment shown removed from the boat.

The best mode for carrying out the invention is presented in terms of a preferred and second embodiment for a fold-away transport platform 24. The preferred embodiment of the fold-away transport platform 24 is attached the stern of a boat 26 and is used to transport sizeable items, such as shown in FIGS. 1 through 19, and consists of a pair of tubular side supports 28 that are pivotally attached to the boat 26. Each side support 28 has a first end 30 and a second end 32, as illustrated in FIGS. 2–6. The first end 30 of each side support 28 has a down-turned radial extremity 34 and the second end 32 is formed with an upturned radial extremity 36, as best illustrated in FIG. 2. This configuration permits the first end 30 to extend downward into the boat 26 for attachment, while the second end 32 provides a barrier for maintaining a secure position when transporting sizeable items on the platform 24 such as canoes, sail boards, inflatable boats, and the like.

A plurality of tubular cross members 38 are positioned between the side supports 28 for structural strength and rigidity of the transport platform 24. The side supports 28 and tubular cross members 38 are preferably made of a metal composition with a weld 40 holding the supports 28 and cross members 38 together at an intersecting joint. The preferred material of the side supports 28 and tubular cross members 38 is stainless steel or aluminum. The side supports 28 and cross members 38 are preferably configured with a round, square, polygonal or a rectangular shape, or any other structural configuration suitable for the application.

Figure 3:
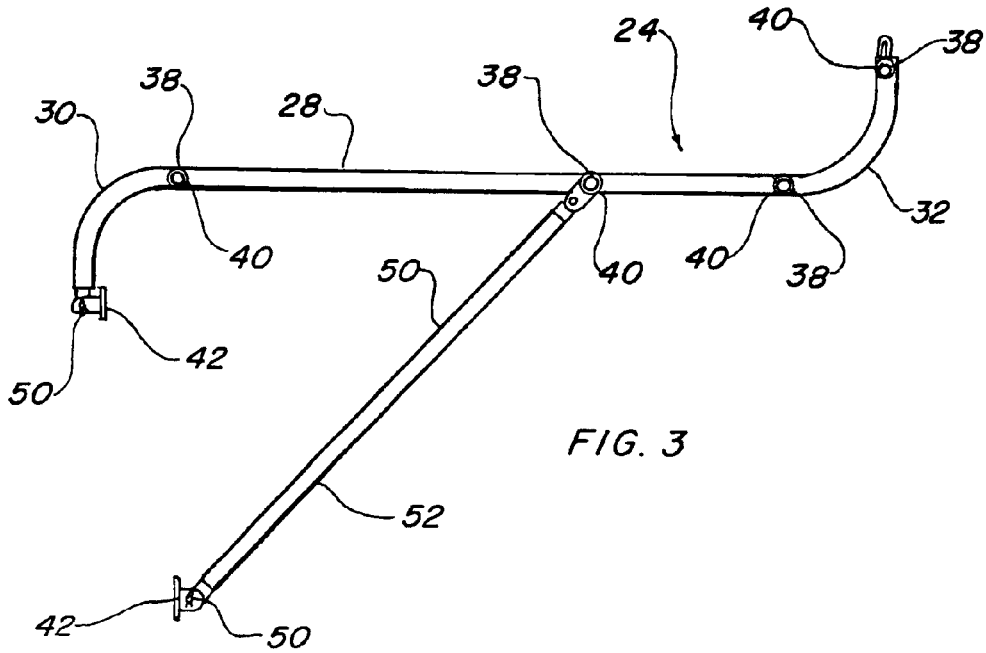
FIG. 3 is a side view of the preferred embodiment.
Figure 4:
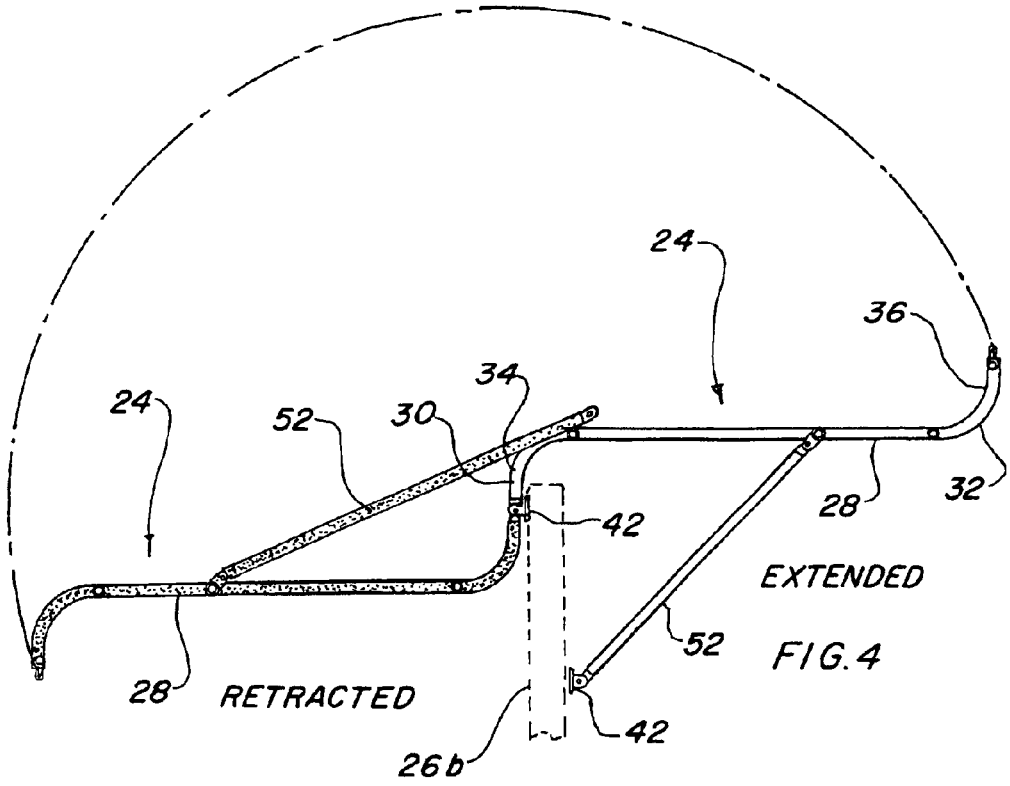
FIG. 4 is a side view of the preferred embodiment illustrated in an extended and retracted mode with the boat shown in dotted lines.
Figure 5:
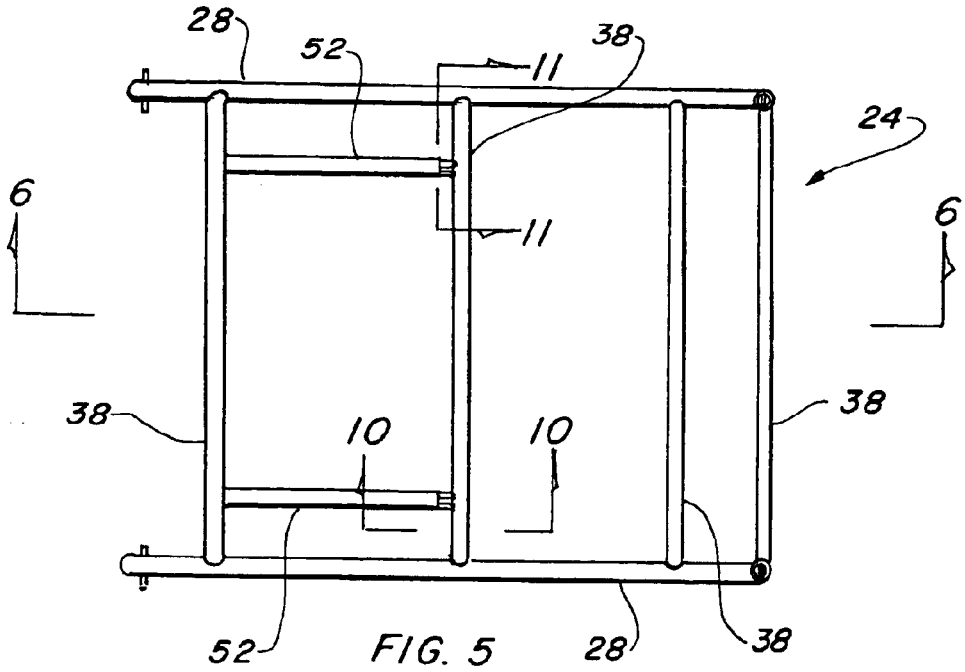
FIG. 5 is a plan view of the preferred embodiment
Figure 6:
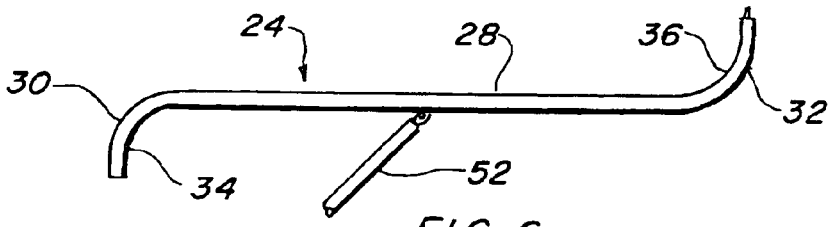
FIG. 6 is a partial cross-sectional view taken along lines 6—6 of FIG. 5.
Figure 8:
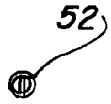
FIG. 8 is an end view of one of the diagonal braces shown removed from the invention for clarity.
Figure 7:
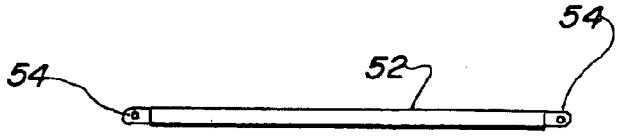
FIG. 7 is a side view of one of the diagonal braces in the preferred embodiment shown removed the invention for clarity.

A pair of stern pivoting hinge brackets 42 are pivotally attached to an internal surface of the stern 26*a* and are in turn attached to the first end 30 of each side support 28, as illustrated in FIGS. 2–4, with the bracket 42 shown by itself removed from the invention in FIG. 8. This attachment method permits the transport platform 24 to extend outward from said stern 26*a* and fold upward into the interior of the boat 26 for storage, as shown in FIG. 4 in its extended and retracted, or folded over position.

Figure 9:
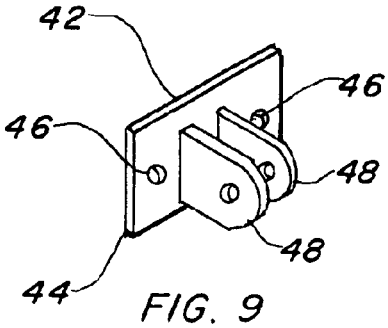
FIG. 9 is a partial isometric view of one of the stern pivoting hinge brackets in the preferred embodiment shown removed from the invention for clarity.
Figure 10:
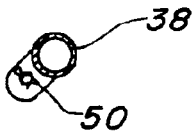
FIG. 10 is a cross-sectional view taken along lines 10—10 of FIG. 5 illustrating a rotatable means for attaching each brace at an upper end to a cross member.
Figure 11:
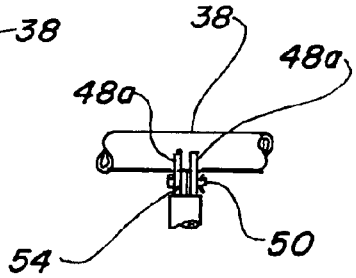
FIG. 11 is a cross-sectional view taken along lines 11—11 of FIG. 5 illustrating a fragmentary side view of the rotatable means for attaching each brace at an upper end to a cross member.

The bracket 42, as illustrated in FIG. 9, consists of a flat mounting plate 44 with provisions for being installed onto the boat transom which consists of holes 46 for mounting with threaded fasteners or the like. A pair of parallel leafs 48 are attached to the plate 44, preferably by welding, with both leafs having means for receiving the first end 30 of the tubular side supports 28, defined as holes 46, sized to receive a clevis pin 50.

Figure 17:
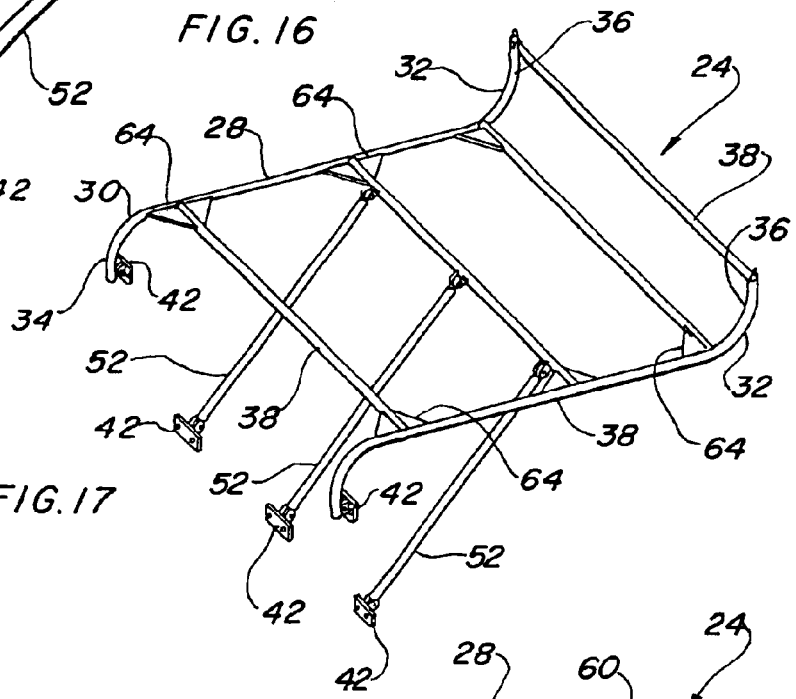
FIG. 17 is a partial isometric view of an embodiment shown by itself away from the boat having three diagonal braces for added strength.
Figure 18:
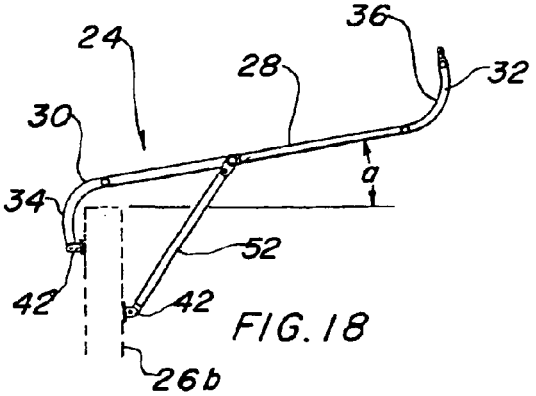
FIG. 18 is a side view of the fold-away platform installed on a boat transom at an angle to assure secure attachment surfaces of the platform.

A plurality of tubular diagonal braces 52 extend between one of the cross members 38 and an external surface of the boat transom 26*b*. Pivotal detachment means are provided for fastening the lower end of each brace to the external surface of the boat ransom 26*b*. It has been found that two diagonal braces 52 are normally sufficient to support conventional loads, however three or more may be used when heavy loads are anticipated on the platform 24, as illustrated in FIG. 17. The pivotal detachment means consists of the use of another pair of identical stern pivoting brackets 42 as described above and as illustrated in FIG. 9. The diagonal braces 52 include a mating plate 54 in the ends, with a hole 46 for connection with a removable clevis pin 50.

Diagonal brace rotatable means are furnished for attaching each brace 52 at its upper end to one of the cross members 38, thereby allowing the platform 24 to be supported diagonally. When the lower end is disengaged, the fold-away transport platform 24 may be rotated into the boat 26, making use of the stern pivoting hinge brackets 42, into a position for storage and transportation.

The diagonal brace rotatable means for attaching each brace at an upper end ta cross member consists of a pair of parallel leafs 48*a* that are preferably attached, by welding to one of the cross members 38, with a clevis pin 50 bridged between said leafs 48*a*. The upper end of the diagonal brace 38, which contains another mating plate 54, has a hole 46 therein, jointly engaged by the clevis pin 50. When the platform 24 is rotated into its storage position, as depicted in FIG. 4, the clevis pin 50 is removed and the diagonal brace 52 is free to rotate but is held by gravity in a vertical position until the side support's first ends 30 are over center. The diagonal brace 52 then slides upon one of the cross members 38 until the side supports 28 come to rest, as illustrated in the retracted position.

Figure 12:
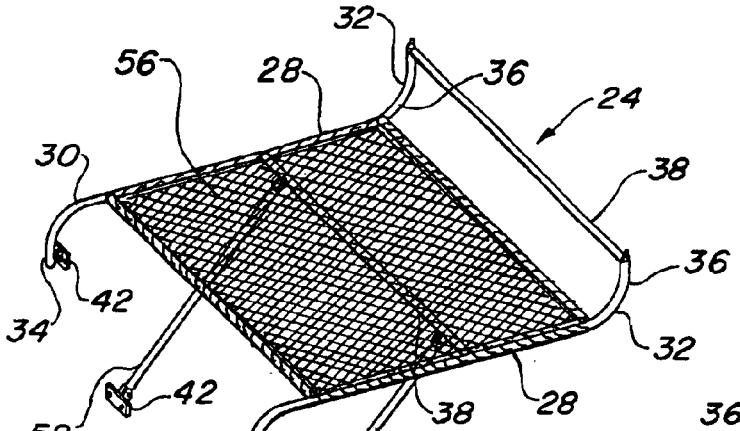
FIG. 12 is a partial isometric view of the preferred embodiment with an external cover consisting of netting.
Figure 13:
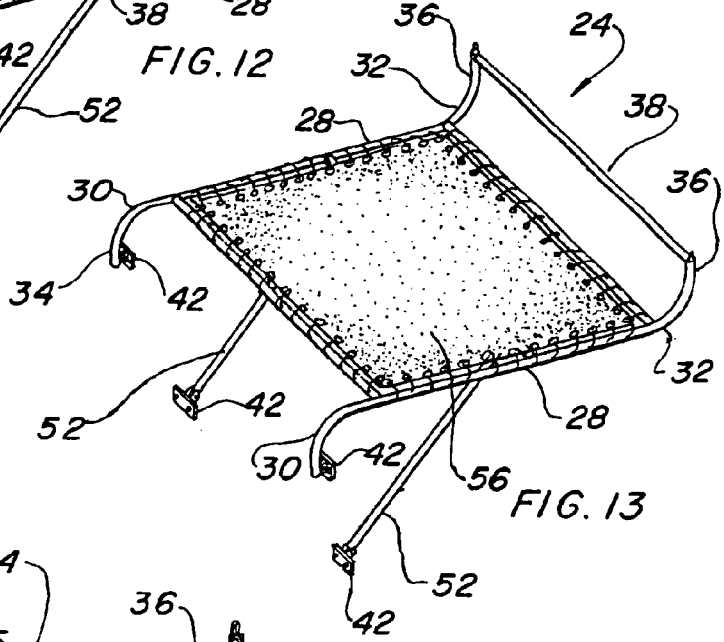
FIG. 13 is a partial isometric view of the preferred embodiment with an external cover consisting of canvas.
Figure 14:
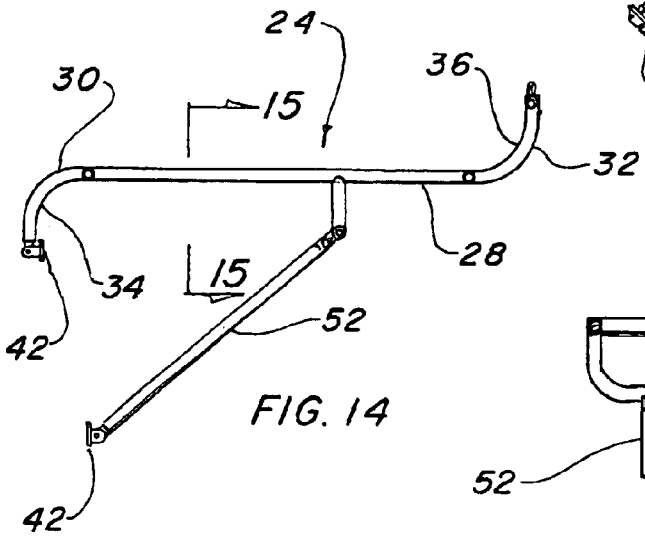
FIG. 14 is a side view of the fold-away platform with a drop-down cross member to facilitate the use of an external cover.
Figure 15:
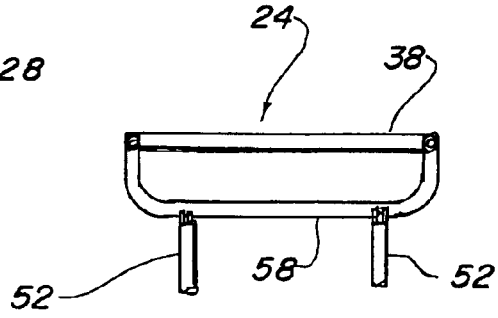
FIG. 15 is a cross-sectional view taken along lines 15—15 of FIG. 14.

An external cover 56 may be stretched on top of the platform 24 for holding smaller goods and/or people. The cover 56 has a resilient surface, which preferably consists of netting, catamaran tarp or canvas. The external cover 56 is illustrated in FIGS. 12 and 13, with FIG. 12 depicting netting and FIG. 13*a* catamaran tarp or canvas. A drop-down cross member 58 replaces a straight cross member 38 in this variation of the preferred embodiment to permit the external cover 56, which is stretched on top of the platform, to yield under weight without touching the cross member itself. The drop down cross member 58 is illustrated in FIGS. 14 and 15.

Figure 16:
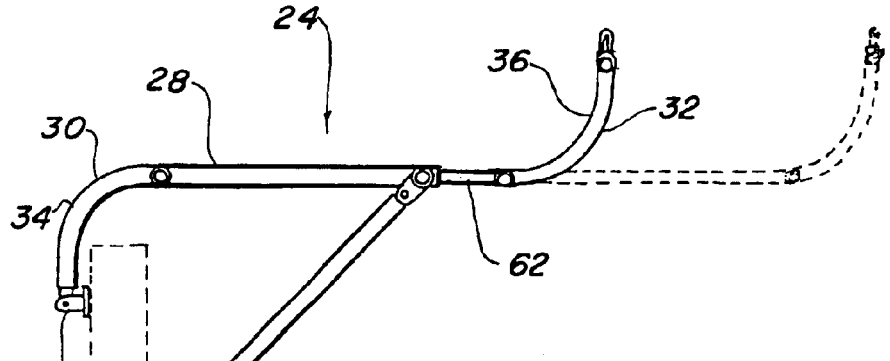
FIG. 16 is a side view of the fold-away platform with extendable side supports.

Another variation of the preferred embodiment is shown in FIG. 16 and consists of a telescoping platform 62 that is adjustable in length of overhang, and has the side supports 28 formed in two sections, with one slipping inside the other.

Figure 19:
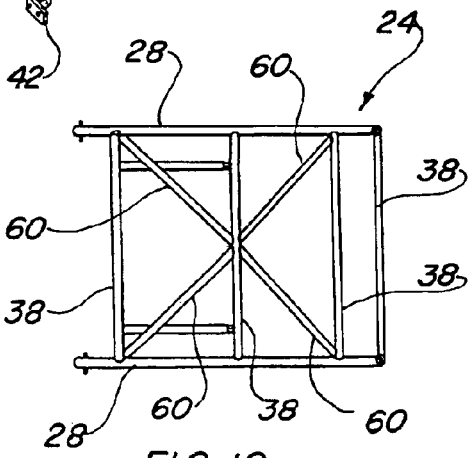
FIG. 19 is a side view of the fold-away platform with cross bracing between the tubular side supports and tubular cross members for additional reinforcing and structural strength.

Cross bracing 60 between the tubular side supports 28 and tubular cross members 38 may optionally be added for additional reinforcement and structural strength, as illustrated in FIG. 19.

In some applications it is preferrable to have the transport platform 24 angled upward from an arbitrary boat mean horizontal centerline from 5 to 10 degrees for assuring that the platform will be capable of maintaining its transported items during rough water. This angled platform variation is shown pictorially in FIG. 18, with the alpha designation "a" representing the upward angle in degrees.

A plurality of gussets 64 may be optionally attached between the side supports 28 and the cross members 38, as illustrated in FIG. 17, to reinforce and strengthen the platform 24. The gussets 64 are flat metallic plates in a triangular shape that are welded to the structural members at the appropriate locations.

Figure 20:
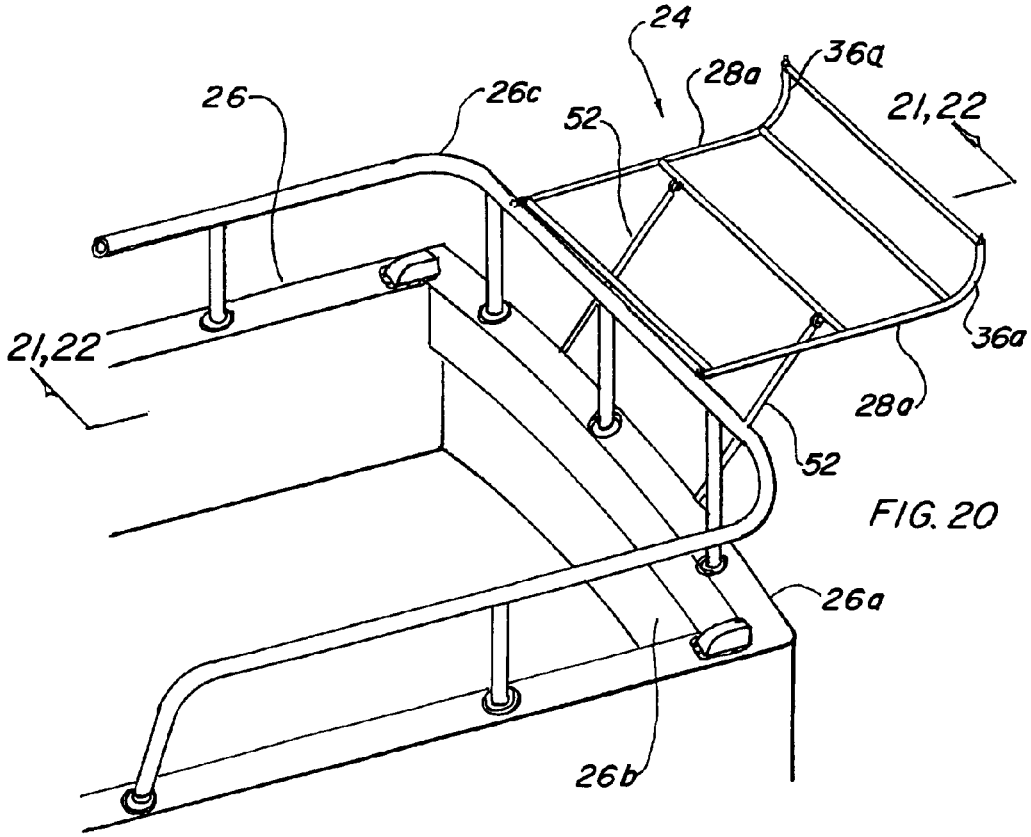
FIG. 20 is a partial isometric view of the fold-away platform attached to the boat stern rail of the second embodiment.
Figure 21:
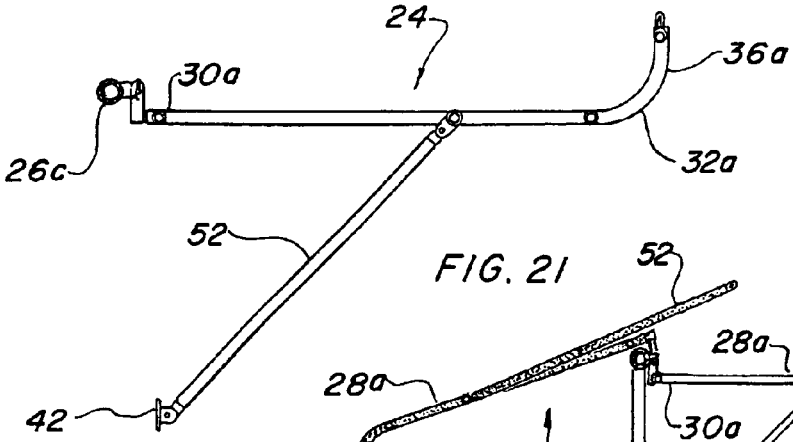
FIG. 21 is a side view of the fold-away platform attached to boat stern rail of the second embodiment.
Figure 22:
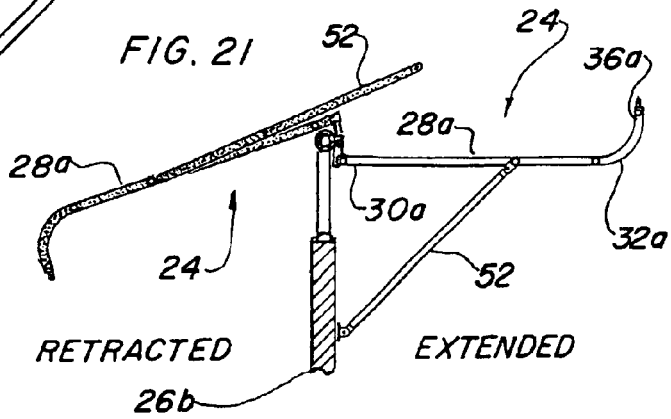
FIG. 22 is a side view of the fold-away platform attached to the boat stern rail of the second embodiment illustrated in the extended and retracted mode with the boat shown in dotted lines.

The second embodiment is basically the same as the preferred embodiment except for the method of attachment of the tubular side supports 28 to the stern of the boat 26. FIGS. 20–22 illustrate this embodiment, which employs different configured side supports 28*a*. The first end 30*a* of each side support 28*a* is straight and said second end 32*a* has the same upturned radial extremity. This design causes the first end 30*a* to be positioned adjacent to the boat stern rail 26*c*. The second end 32*a* radial extremity provides a barrier on the distal end for maintaining a secure position when transporting sizeable items on the platform 24.

The first ends 30*a* of the side supports 28*a* are attached to the boat stern rail 26*c*, as best illustrated in FIG. 21, with the same attachment elements as the preferred embodiment in the first end 30*a*, except that they are rotated upward instead of inward. The stern pivoting hinge bracket 42 of the preferred embodiment is replaced by a pair of leafs 48*a*. The leafs 48*a* are attached directly to the boat stern rail 26*c*, similar to the diagonal brace attachment onto the cross members 38, and a clevis pin 50 provides the pivoting joint.

The diagonal braces 52 pivotal detachment means consists of the same stern pivoting hinge bracket 42 which is a flat mounting plate 22 with provisions for installing onto the boat transom and parallel leafs 48. The connection between the brace 52 and the bracket 42 is achieved by utilizing a removable clevis pin 52 bridged between the leafs 48. The attachment of the upper end of the diagonal braces 52 is identical to the preferred embodiment, as described above.

It should be noted that the retraction of the platform 24 in the second embodiment is shown pictorially in FIG. 22, and when retracted, the diagonal brace 52 rests directly on the boat stern rail 26*c* instead of one of the cross members 38.

While the invention has been described in complete detail and pictorially shown in the accompanying drawings, it is not to be limited to such details, since many changes and modifications may be made to the invention without departing from the spirit and scope thereof. For example, the fold-away transport platform can also be designed to be utilized on various types of land vehicles. Hence, it is described to cover any and all modifications and forms which may come within the language and scope of the appended claims.

What is claimed is:

1. A fold-away transport platform attached to a boat transom for carrying sizeable items comprising:

a) a pair of tubular side supports pivotally attached to the boat, each side support having a first end and a second end, wherein said first end of said tubular side supports having a down-turned radial extremity, and said second end of said tubular side supports having an upturned radial extremity, such that the first end extends downwardly into the boat and the second end provides a barrier on the distal end for maintaining a secure position when transporting sizeable items on said platform, b) a plurality of tubular cross members positioned between the side supports for structural strength and rigidity of the transport platform, c) a pair of stern pivoting hinge brackets, each hinge bracket pivotally attached to an internal surface of said boat stern and to said first end of each side support, with the transport platform extending outwardly from said boat stern, and d) a plurality of tubular diagonal braces having pivotal detachment means for fastening each brace to an external surface of said boat transom on a lower end of said brace, and rotatable means for attaching each brace at an upper end to a cross member such that the platform may be supported diagonally, and when the lower end is disengaged, the fold-away transport platform may be rotated into the boat, thus making use of said stern pivoting hinge brackets, into a position for storage and transportation.

2. The boat fold-away transport platform as recited in claim 1 wherein said tubular side supports and tubular cross members comprise a metal composition with a weld holding the supports and cross members together at an intersection therebetween.

3. The boat fold-away transport platform as recited in claim 1 wherein said tubular side supports and tubular cross members are formed from stainless steel.

4. The boat fold-away transport platform as recited in claim 1 wherein said tubular side supports and tubular cross members are formed from aluminum.

5. The boat fold-away transport platform as recited in claim 2 wherein said tubular side supports and tubular cross members are configured from the group consisting of a round shape, a square shape, an polygonal shape and a rectangular shape.

6. The boat fold-away transport platform as recited in claim 1 wherein said stern pivoting hinge brackets each comprise a flat mounting plate having provisions for being installing onto the boat transom, and parallel leafs each having means for receiving said first end of said tubular side supports.

7. The boat fold-away transport platform as recited in claim 1 wherein said tubular diagonal braces pivotal detachment means further comprising a flat mounting plate with provisions for installing onto the boat transom, and parallel leafs each having a clevis pin bridged between said leafs, wherein said clevis pin capable of being removed.

8. The boat fold-away transport platform as recited in claim 1 wherein each tubular diagonal braces rotatable means for attaching each brace at an upper end to a cross member further comprising a pair of parallel leafs attached to one of the cross members, with a clevis pin bridged between said leafs and said upper end of the diagonal braces, said braces having a mating plate with a hole therein jointly engaged by said clevis pin.

9. The boat fold-away transport platform as recited in claim 1 further comprising an external cover stretched on top of said platform and selected from the group consisting of netting, catamaran tarp and canvas.

10. The boat fold-away transport platform as recited in claim 9 wherein at least one of said cross members is a drop-down cross member to permit the external cover stretched on top of said platform to yield under weight without touching the cross member.

11. The boat fold-away transport platform as recited in claim 1 further comprising a telescoping platform that is adjustable in length of overhang, and having the side supports formed in two sections, with one slipping inside the other.

12. The boat fold-away transport platform as recited in claim 1 further comprising cross bracing between the tubular side supports and tubular cross members for additional reinforcing and structural strength.

13. The boat fold-away transport platform as recited in claim 1 further comprising said transport platform angled upward from the boat mean horizontal centerline from 5 to 10 degrees for assuring that the platform will be capable of maintaining its transported items during rough water.

14. The boat fold-away transport platform as recited in claim 1 further comprising a plurality of gussets attached between the side supports and the cross members to reinforce and strengthen the platform.

15. A fold-away transport platform attached to a boat transom for carrying sizeable items comprising:

a) a pair of tubular side supports pivotally attached to the boat, each side support having a first end and a second end, wherein said first end of said tubular side supports straight and said second end of said tubular side supports have an upturned radial extremity, wherein the first end is positioned adjacent to the boat stern rail, and the second end radial extremity provides a barrier on its distal end for maintaining a secure position when transporting sizeable items on said platform, b) a plurality of tubular cross members positioned between the side supports for structural strength and rigidity of the transport platform, c) a pair of stern pivoting hinge brackets, each hinge bracket pivotally attached to an internal surface of said boat stern and to said first end of each side support with the transport platform extending outwardly from said boat stern, and d) a plurality of tubular diagonal braces having pivotal detachment means for fastening each brace to an external surface of said boat transom on a lower end of said brace, and rotatable means for attaching each brace at an upper end to a cross member such that the platform may be supported diagonally and when the lower end is disengaged, the fold-away transport platform may be rotated into the boat, thus making use of said stern pivoting hinge brackets, into a position for storage and transportation.

16. The boat fold-away transport platform as recited in claim 15 further comprising stern pivoting hinge brackets each having a pair of parallel leafs attached to an upper portion of said boat stern rail, each pair of brackets having means for receiving said first end of said tubular side supports.

17. A fold-away transport platform attached to a stern portion of boat for carrying sizeable items comprising side supports, having a first end and a second end wherein said first end of said side supports having a down-turned radial extremity, and said second end of said tubular side supports having an upturned radial extremity, such that the first end extends downwardly into the boat and the second end provides a barrier on the distal end, a plurality of cross members, disposed between said side supports forming a platform, pivoting hinge brackets attached to said side supports and to said boat stern, and a plurality of diagonal braces fastened to said boat and said cross member such that the brace may be detached and the platform pivoted into the boat for transportation and storage.

* * * * *